US006334473B1

(12) United States Patent
Dumargue

(10) Patent No.: US 6,334,473 B1
(45) Date of Patent: Jan. 1, 2002

(54) INSTALLATION FOR FILLING CONTAINERS

(75) Inventor: Guy Dumargue, Cherre (FR)

(73) Assignee: Serac Group, LaFerte Bernard (FR)

( * ) Notice: Subject to any disclaimer, the term of this patent is extended or adjusted under 35 U.S.C. 154(b) by 0 days.

(21) Appl. No.: 09/722,819

(22) Filed: Nov. 28, 2000

(30) Foreign Application Priority Data

Nov. 30, 1999 (FR) ..... 99 15054

(51) Int. Cl.[7] ..... B65B 43/42; B67C 3/00

(52) U.S. Cl. ..... 141/144; 141/91; 141/99; 141/145

(58) Field of Search ..... 141/85, 89, 91, 141/97, 99, 100, 129, 135, 144, 145

(56) References Cited

U.S. PATENT DOCUMENTS 4,588,001 A * 5/1986 Leonard ..... 141/5
5,396,936 A * 3/1995 Nalbach et al. ..... 141/144
6,148,876 A * 11/2000 Corniani et al. ..... 141/84

FOREIGN PATENT DOCUMENTS

| | | |
|---|---|---|
| CH | 383192 | 4/1961 |
| DE | 2736206 | 2/1979 |
| DE | 3229982 | 1/1984 |

* cited by examiner

*Primary Examiner*—Timothy L. Maust
(74) *Attorney, Agent, or Firm*—Birch, Stewart, Kolasch & Birch, LLP

(57) ABSTRACT

A filling installation comprising a fixed frame, a tank mounted on the fixed frame so as to rotate about an axis, and a lid associated with the tank and provided with a feed pipe, positioning means being fixed to the lid, and being mounted on the fixed frame to slide parallel to the axis of rotation between a position in which the lid is applied against an edge of the tank so as to close off said tank and a position in which the lid is spaced apart from the edge of the tank.

7 Claims, 1 Drawing Sheet

INSTALLATION FOR FILLING CONTAINERS

The present installation relates to an installation for filling containers, such an installation serving, for example, in a bottling line.

BACKGROUND OF THE INVENTION

A filling installation generally includes a filling platform of the carrousel type which is mounted to rotate about an axis on a fixed frame, and it continuously fills containers conveyed along the bottling line. To this end, it includes a tank to which filling nozzles are connected.

In sterile filling installations, i.e. installations in which filling is performed without any germs entering the containers during the various steps of packaging the substance, a lid is fixed to the tank in sealed manner. The lid is provided with a valve which is controlled to put the tank in communication with the ambient atmosphere, as maintained in a sterile state, during the container-filling stage, and with a circuit for dispensing a cleaning substance during a periodic cleaning stage.

The filling liquid is fed to the tank via a pipe having one end fixed to the lid via a rotary gasket so as to open out into the tank. The tank is thus filled continuously even while it is rotating during filling of the containers. The need for a rotary gasket complicates the structure of the installation. In addition, the rotary gasket is subject to wear, and the duct connecting the valve to the circuit for dispensing the cleaning substance must also be connected to the rotary gasket, and so the rotary gasket is of complex structure.

OBJECTS AND SUMMARY OF THE INVENTION

An object of the invention is to provide a filling installation that has a structure making it possible to omit the rotary gasket.

To this end, the invention provides a filling installation comprising a fixed frame, a tank mounted on the fixed frame so as to rotate about an axis, and a lid associated with the tank and provided with a feed pipe, positioning means being fixed to the lid, and being mounted on the fixed frame to slide parallel to the axis of rotation between a position in which the lid is applied against an edge of the tank so as to close off said tank and a position in which the lid is spaced apart from the edge of the tank.

Thus, during the filling stage, the positioning means are actuated so as to maintain the lid spaced apart from the edge of the tank. In this position, the lid is prevented from rotating relative to the frame. The feed pipe can thus be fixed rigidly to the lid without it being necessary to use a rotary gasket. In addition, when the lid is in this position, the tank is naturally in communication with the ambient atmosphere. For the cleaning stage, the positioning means are actuated so that the lid closes off the tank. The tank can then be cleaned by injecting the cleaning substance under a high pressure, thereby facilitating proper cleaning of the tank.

In a particular embodiment, the positioning means include at least one arm having a first end fixed to the lid and a second end mounted to slide on a column secured to the frame. Preferably, the edge of the tank is provided with an annular rim projecting-outwards from the tank, and the lid comprises a plate from which a cylindrical wall extends that surrounds the annular rim, and that has an annular internal shoulder extending facing the rim, the positioning means including an abutment for limiting the downward movement of the lid, and at least one actuator having a body secured to the lid and a moving rod angularly positioned so that, when it is in the deployed position, it comes into abutment against an abutment piece secured to or integral with the tank. Thus, the lid is spaced apart from the edge of the tank merely by the weight of the lid, and it is necessary to feed the actuators only to seal the tank during washing.

In addition, in order to produce batches comprising containers filled with different substances, e.g. with a plurality of flavors of flavored dairy produce, it is necessary with known types of installation to fill series of containers separately with respective ones of the substances, and then to store said series until all of the series of containers have been filled, and finally to package the batches of containers by combining the various series. Such manufacture assumes that large storage volumes are available, and it suffers from poor productivity.

According to a particular characteristic of the invention, at least one cylindrical wall extends coaxially inside the tank so as to partition said tank into compartments, and at least one second feed pipe equips the lid, the feed pipes passing through the lid so as to open out in the tank, each pipe opening out facing a respective one of the compartments.

Thus, different filling substances can be fed respectively to the compartments via feed pipes that still face the same respective ones of the compartments while the tank is rotating. Each filling nozzle can then be connected selectively to the compartment that contains the filling substance that the container to be filled is to contain, so that batches with different substances can be produced by taking successive containers.

Other characteristics and advantages of the invention will appear on reading the following description of a particular non-limiting embodiment of the invention.

BRIEF DESCRIPTION OF THE DRAWING

Reference is made to the accompanying sole figure which is a fragmentary view in section on a vertical axial plane, showing a filling installation of the invention.

MORE DETAILED DESCRIPTION

Figure 1:
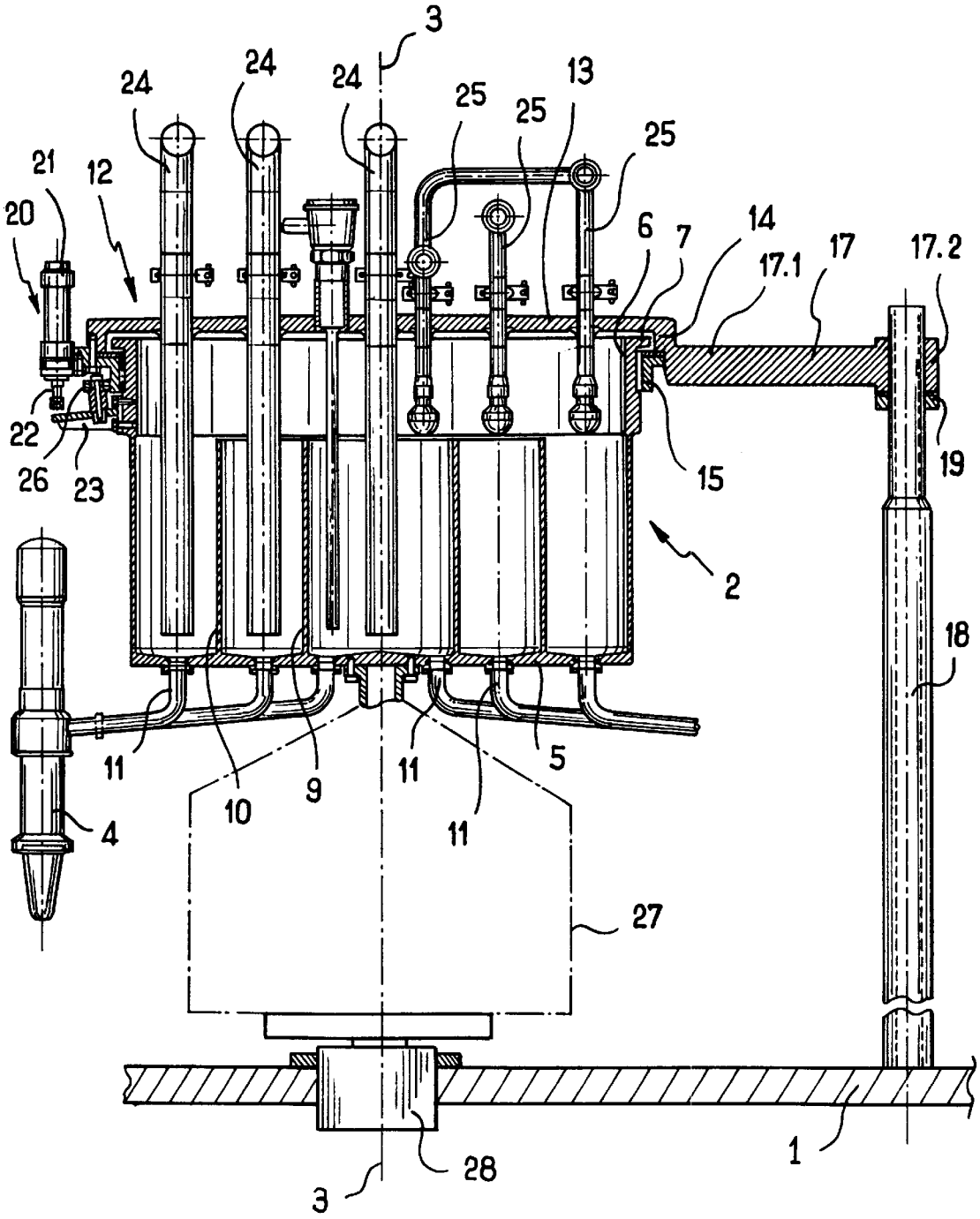

The filling installation of the invention includes a fixed frame 1 on which a tank given overall reference 2 is mounted via a structure 27 represented in chain-dotted lines and carried by a bearing 28 so as to rotate about an axis 3. The tank 2 is part of a filling platform of the carrousel type, and it is connected to filling nozzles 4 that are known per se, only one of which is shown in the figure.

The tank 2 is of cylindrical shape and it comprises a bottom 5 and a top opening 6 opposite from the bottom 5, and an annular rim 7 adjacent to the opening 6 and projecting outwards.

Two partitions 9 and 10 that are of cylindrical shape and that are centered on the axis 3 extend inside the tank 2, and they subdivide said tank into three compartments, the bottoms of which receive ducts 11 that open out in said bottoms and that are selectively connected to filling nozzles 4.

The installation includes a lid designated by overall reference 12 and covering the top portion of the tank 2.

The lid 12 comprises a plate 13 from which a cylindrical wall 14 extends that surrounds the rim 7. A ring 15 that has an inside diameter smaller than the outside diameter of the rim 7 is fixed to the edge of the cylindrical wall 14 that is opposite from the plate 13. The ring 15 thus defines an internal annular shoulder equipped with a sealing gasket extending under the rim 7 of the tank 2.

Positioning means are fixed to the lid 12.

In the embodiment shown, the positioning means include three arms 17 (only one of which is visible in the figure) extending radially at 120° relative to one another about the axis 3, each arm having one end 17.1 fixed to the lid 12 and its opposite end 17.2 in the form of a yoke and mounted on a column 18 parallel to the axis 3 and fixed to the frame 1. The ends 17.2 are slidably mounted on the columns 18. In a low position shown in the figure, the ends 17.2 abut against rings 19 which are carried by the columns 18, and which form abutments for the ends,17.2 of the arms 17. In this position, the internal shoulder 15 of the lid 12 is spaced apart from the rim 7. The arms 17 prevent the lid 12 from rotating relative to the frame 1.

The positioning means also include actuators that are given overall reference 20, only one of which is visible in the figure. The actuators are uniformly distributed about the axis 3 in a configuration that is offset relative to the arms 17. Each actuator 20 comprises a body 21 fixed to the lid 12 and a rod 22 that can be actuated between a deployed position in which the free end of the rod 22 abuts against a fixed piece 23 projecting outwards from the tank 2 so as to form an integral part of said tank, and a retracted position (as shown in the figure) in which the free end of the rod 22 is released from said piece 23.

The installation includes feed pipes 24, each of which has an end connected to a supply (not shown) of filling substance, the feed pipes passing through the lid 12 and opening out into the tank facing respective ones of the compartments. The feed pipes 24 are coupled to the lid 12 in sealed manner.

The installation also includes pipes 25 for dispensing a cleaning substance, each of which pipes has an end connected to a supply (not shown) of cleaning substance and passes through the lid 12 to open out into the tank facing a respective one of the compartments. The pipes 25 are coupled to the lid 12 in sealed manner.

During filling, the rods 22 of the actuators 20 are retracted so that, under the effect of its own weight, the lid is supported in the low position by the arms 17 whose ends 17.2 are in abutment against the abutment rings 19 on the columns 18. The internal shoulder 15 of the lid 12 is then spaced apart from the rim 7 so that the lid 12 does not hinder rotation of the tank 2. It should be noted that wheels 26 are fixed to the portions 23 so as to be in abutment against the outside surface of the ring 15 and so as to guide the tank 2 in rotation relative to the lid 12. In addition, when the lid is in the low position, the tank 2 is in communication with the outside atmosphere. While the tank 2 is rotating, filling substances are inserted into the corresponding compartments via the feed pipes 24.

During cleaning, the rotation of the tank 2 is stopped so that the tank is in a position in which the actuators 20 face the portions 23, and the rods 22 of the actuators 20 are deployed to bear against the portions 23 of the tank. The lid is raised by reaction. The internal shoulder 15 of the lid 12 is then applied against the rim 7 so that the lid 12 closes off the tank 2. The cleaning liquid is then injected into the tank 2 via the pipes 25. It should be noted that, in the embodiment described, the actuators 20 are fed only during the cleaning stage.

The feed pipes 24 and the pipes 25 include flexible hose portions enabling them to accommodate the lid 12 being displaced between its high and low positions.

Naturally, the invention is not limited to the embodiment described, and variant embodiments are possible without going beyond the ambit of the invention as defined by the claims.

In particular, the free end of the rod of each actuator may be equipped with a wheel so as to roll on a piece 23 that is of annular shape. The low position of the lid is then defined by the retracted position of the rods of the actuators, without abutment shoulders being necessary on the columns 18.

In addition, the lid and the positioning means may be organized so that the lid closes off the tank when said lid is in the low position, and so that it is spaced apart from the tank when it is in the high position. In which case, the lid may be suspended above the tank. Instead of providing anti-rotation arms 17 and actuators 20 carried by the lid, it is then possible for the lid to be carried by actuators, each of which has one end fixed to a portion of the frame extending above the lid, and one end fixed to the lid. The actuators then serve as actuating members and as abutment members for the lid.

When substance is to be packaged in sterile manner, the installation is placed in a stream of sterile air flowing vertically from top to bottom. In which case, a sterile air intake pipe may be fixed to the lid so that it passes therethrough, said pipe having a top end opening out into the stream of sterile air, and a bottom end opening out under the lid. To enable pressurization to take place during cleaning, the sterile air intake is preferably equipped with a valve.

What is claimed is:

1. A filling installation comprising a fixed frame, a tank mounted on the fixed frame so as to rotate about an axis, and a lid associated with the tank and provided with a feed pipe, wherein positioning means are fixed to the lid, and are mounted on the fixed frame to slide parallel to the axis of rotation between a position in which the lid is applied against an edge of the tank so as to close off said tank and a position in which the lid is spaced apart from the edge of the tank.

2. A filling installation according to claim 1, wherein the positioning means include at least one arm having a first end fixed to the lid and a second end mounted to slide on a column secured to the frame.

3. A filling installation according to claim 1, wherein the edge of the tank is provided with an annular rim projecting outwards from the tank, and the lid comprises a plate from which a cylindrical wall extends that surrounds the annular rim, and that has an annular internal shoulder extending under the rim.

4. A filling installation according to claim 3, wherein the positioning means include an abutment for limiting the downward movement of the lid, and at least one actuator having a body secured to the lid and a moving rod angularly positioned so that, when it is in the deployed position, it comes into abutment against a portion of the tank.

5. An installation according to claim 4, wherein the positioning means include at least one arm having a first end fixed to the lid and a second end mounted to slide on a column secured to the frame, and wherein each column is provided with an abutment-forming ring.

6. A filling installation according to claim 1, including centering means for centering the lid relative to the tank.

7. A filling installation according to claim 1, wherein at least one cylindrical wall extends coaxially inside the tank so as to partition said tank into compartments, and wherein at least one second feed pipe equips the lid, the feed pipes passing through the lid so as to open out in the tank, each pipe opening out facing a respective one of the compartments.

* * * * *